United States Patent [19]

Garris

[11] Patent Number: 4,601,569

[45] Date of Patent: Jul. 22, 1986

[54] APPARATUS FOR CLEANING A PHOTOCONDUCTOR

[75] Inventor: Vladimir A. Garris, Rochester, N.Y.

[73] Assignee: Eastman Kodak Company, Rochester, N.Y.

[21] Appl. No.: 683,734

[22] Filed: Dec. 19, 1984

[51] Int. Cl.[4] ..... G03G 21/00

[52] U.S. Cl. ..... 355/15; 15/256.52

[58] Field of Search ..... 355/3 R, 15; 15/256.51, 15/256.52

[56] References Cited

U.S. PATENT DOCUMENTS

| | | | |
|---|---|---|---|
| Re. 28,566 | 10/1975 | Yang | 355/15 |
| 3,706,108 | 12/1972 | Taylor | 15/1.5 |
| 3,848,994 | 11/1974 | Fraser | 355/15 |
| 3,917,398 | 11/1975 | Takahashi et al. | 355/15 |
| 3,951,542 | 4/1976 | Ito et al. | 355/15 |
| 4,172,303 | 10/1979 | Wooding et al. | 355/15 X |
| 4,313,674 | 2/1982 | Ura et al. | 355/15 |
| 4,323,306 | 4/1982 | Ito et al. | 355/15 |
| 4,325,628 | 4/1982 | Torigai et al. | 355/15 |
| 4,326,315 | 4/1982 | Miles et al. | 355/15 X |
| 4,348,103 | 9/1982 | Kawazu et al. | 355/15 |
| 4,361,922 | 12/1982 | Karal | 355/15 X |
| 4,390,268 | 6/1983 | Furuichi et al. | 355/15 |
| 4,402,103 | 9/1983 | Yanagawa et al. | 355/15 X |
| 4,411,042 | 10/1983 | Sakata et al. | 355/15 X |
| 4,427,289 | 1/1984 | Oda | 355/15 |
| 4,530,597 | 7/1985 | Itaya et al. | 355/15 |

OTHER PUBLICATIONS

Research Disclosure 16151, Sep. 1977, "Oscillating Cleaner".

Research Disclosure 24527, Sep. 1984, "Cleaning Apparatus".

*Primary Examiner*—Fred L. Braun

*Attorney, Agent, or Firm*—Herman J. Strnisha

[57] ABSTRACT

A cleaning apparatus includes a magnetic cleaning brush for removing residual toner from a photoconductor. A hollow rotating detoning roller electrostatically removes toner from the cleaning brush. The detoning roller has apertures in the surface thereof allowing toner to be mechanically swept by a skiving blade into the hollow portion of the detoning roller. A stationary auger transports the toner to one end of the roller where it may be vacuumed up.

13 Claims, 3 Drawing Figures

APPARATUS FOR CLEANING A PHOTOCONDUCTOR

BACKGROUND OF THE INVENTION

1. Field of the Invention

This invention relates to electrophotography, and more particularly to an improved apparatus for removing residual toner particles from a surface of a photoconductor.

2. Description of the Prior Art

In known electrophotographic reproduction apparatus such as copiers or non-impact printers, an electrostatic charge is deposited on an area of a photoconductor as the area is moved past a charging station. The photoconductor is then moved to an exposure station where the area is exposed to image-forming radiation to form a latent electrostatic image of information to be reproduced. The latent image is thereafter developed by depositing opaque electroscopic particles, such as toner particles, on the photoconductor and, in the case of plain-paper copiers and non-impact printers, the developed image is subsequently, during a transfer step transferred to paper upon which the copied image is to appear. Thereafter, the photoconductor is cleaned and otherwise made ready for the next copy cycle.

In such apparatus, it is important for ensuring image quality to remove, before the next copy cycle, any residual toner particles remaining on the photoconductor after the transfer step.

In U.S. Pat. No. Re. 28,566, a magnetic brush cleaning roller is described which can be used to remove such residual toner particles. The magnetic brush roller includes bristles or a nap formed of discrete magnetic carrier beads which are carried on a rotating surface of the roller and which upon scrubbing engagement with the surface of the photoconductor are able to remove the toner particles from the photoconductor and retain them in the nap from which the toner particles subsequently can be removed. The toner particles are removed from the nap by placing a detoning roller which comprises an electrically biased metallic surface, in proximity to the nap so that the toner particles are electrostatically removed from the magnetic brush roller onto the detoning roller. The particles are thereafter scraped from the detoning roller and allowed to fall to a catch tray located below the detoning roller. The toner may be allowed to accumulate in the catch tray or as shown in U.S. Pat. No. 4,402,103 the catch tray may be provided with an auger or other conveying means for conveying the toner particles to a developer station or toner recycling station for reuse. While the apparatus described works well in cleaning the photoconductor, scattering of toner particles to other areas than its intended point of collection is made likely by allowing the free fall of toner particles in an environment where air currents are created by rapidly rotating members.

As indicated above, an advantageous feature of a cleaning apparatus is for it to have the ability to convey toner particles from the cleaning station to a collection device for disposal or for recirculation. The use of the toner conveying arrangement indicated above would require an additional means be provided for driving an auger or the like. The addition of the auger and a drive therefor increases the number of moving parts and the size of the charging station.

It is therefore an object of the invention to provide an apparatus which overcomes the disadvantages of the prior art as set forth above.

SUMMARY OF THE INVENTION

The present invention provides an improved apparatus for removing residual toner particles from the surface of a photoconductor. More particularly the invention is directed to an apparatus for cleaning a surface such as a photoconductor wherein a photoconductor cleaning member has a moving surface and a short bristlelike nap thereon for scrubbing the photoconductor to remove residual toner therefrom, detoning means is provided to remove toner particles from the nap and includes a surface movable about a closed path; the improvement comprises means for removing the toner particles from the detoning means and for directing the toner particles into a space encompassed by the closed path of the detoning means.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Because apparatus of the type described herein are well known, the present description will be directed in particular to elements forming part of or cooperating more directly with the present invention.

Figure 1:
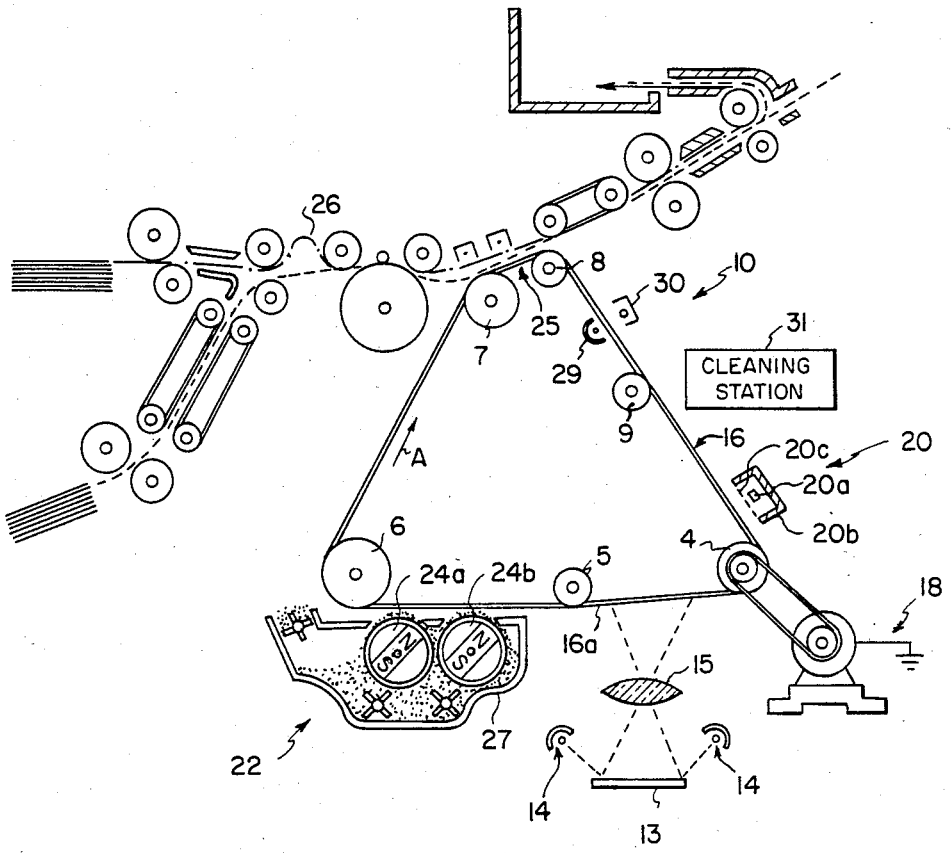
FIG. 1 is a side elevational view in schematic form of a prior art copier apparatus in which the invention may be utilized.

For a general understanding of a web-type electrophotographic copier/duplicator apparatus 10 wherein the invention has utility, reference is made to FIG. 1. As shown, a photoconductor member, in the form of a photoconductive web 16, is trained about rollers 4 through 9 for movement in the direction indicated by the arrow A. Roller 4 is driven by a drive mechanism 18 shown for simplicity to include a motor-pulley arrangement. An insulating layer or surface **16*a* of the web 16 is charged at a conventional corona charge station (charger) 20 with a suitable negative charge. The charger 20 may include one or more corona generating wires, a shield, and a grid for regulating the flow of negative corona current from the wires to the photoconductor member. Thereafter and at an appropriate time, an information medium 13 such as a document is illuminated at an image exposure station by radiation from flash lamps 14. Such radiation is reflected from the medium and projected by a lens 15 onto the charged insulating layer 16*a* of the web 16, to selectively dissipate charge and form an electrostatic latent image of medium 13** on a specific area of the web. For more specific disclosures of the web, see commonly assigned U.S. Pat. Nos. 3,615,406 and 3,615,414, both issued Oct. 26, 1971.

The apparatus 10 further includes a development station 22 at which the moving electrostatic image is contacted with finely divided charged toner particles that adhere to the charged web surface in a configuration defined by the electrostatic image, to form a visible toner image; a transfer station 25 in which the toner image is transferred to a receiving surface of a copy sheet 26 on which it can be subsequently permanently fused; and a cleaning station 31 in which residual toner particles are removed from the web 16.

At the development station an electrostatic image on the insulating layer 16*a* of web 16 is moved past two magnetic brushes or rollers 24*a* and 24*b* mounted in a housing 27 of the development station 22. The housing 27 holds a supply of developer containing a mixture of nonmagnetic electroscopic toner particles and magnetic carrier particles. The brushes 24*a* and 24*b* can be constructed according to any one of a variety of designs known in the prior art. One such design is shown in commonly assigned U.S. Pat. No. 3,543,720 issued Dec. 1, 1970, in the names of Drexler et al. For a specific example of such a developer, see commonly assigned U.S. Pat. No. 3,893,935, issued July 8, 1975 to Jadwin et al. For a more complete description of the general organization of a similar copier apparatus, reference may be made to commonly assigned U.S. Pat. No. 4,025,186, issued May 24, 1977 to Hunt et al.

Although a web-type copier/duplicator has been shown, it will be understood that the present invention is also particularly suitable with copier/duplicator or non-impact printer apparatus that use drums and also sheet film photoconductors. In any case, it will be understood by those skilled in the art that a microcomputer having a stored program can be effectively used as the logic and control apparatus to control the operation of the copier/duplicator. The details of one such microcomputer is disclosed in the above-referenced U.S. Pat. No. 4,025,186.

Figure 2:
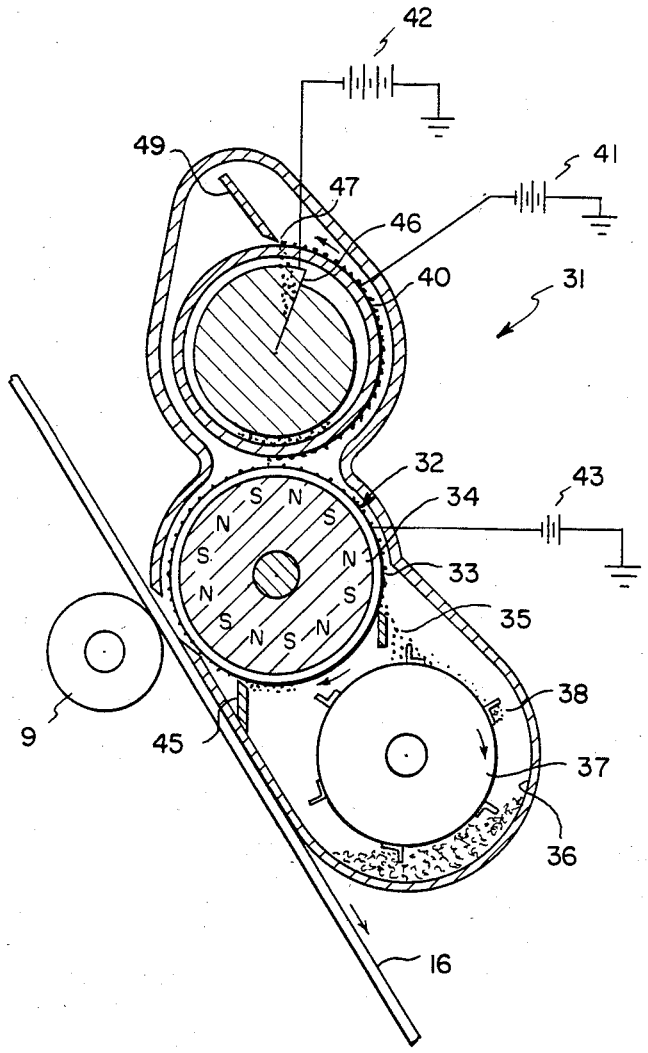
FIG. 2 is a side elevational view of a cleaning apparatus made in accordance with the invention.
Figure 3:
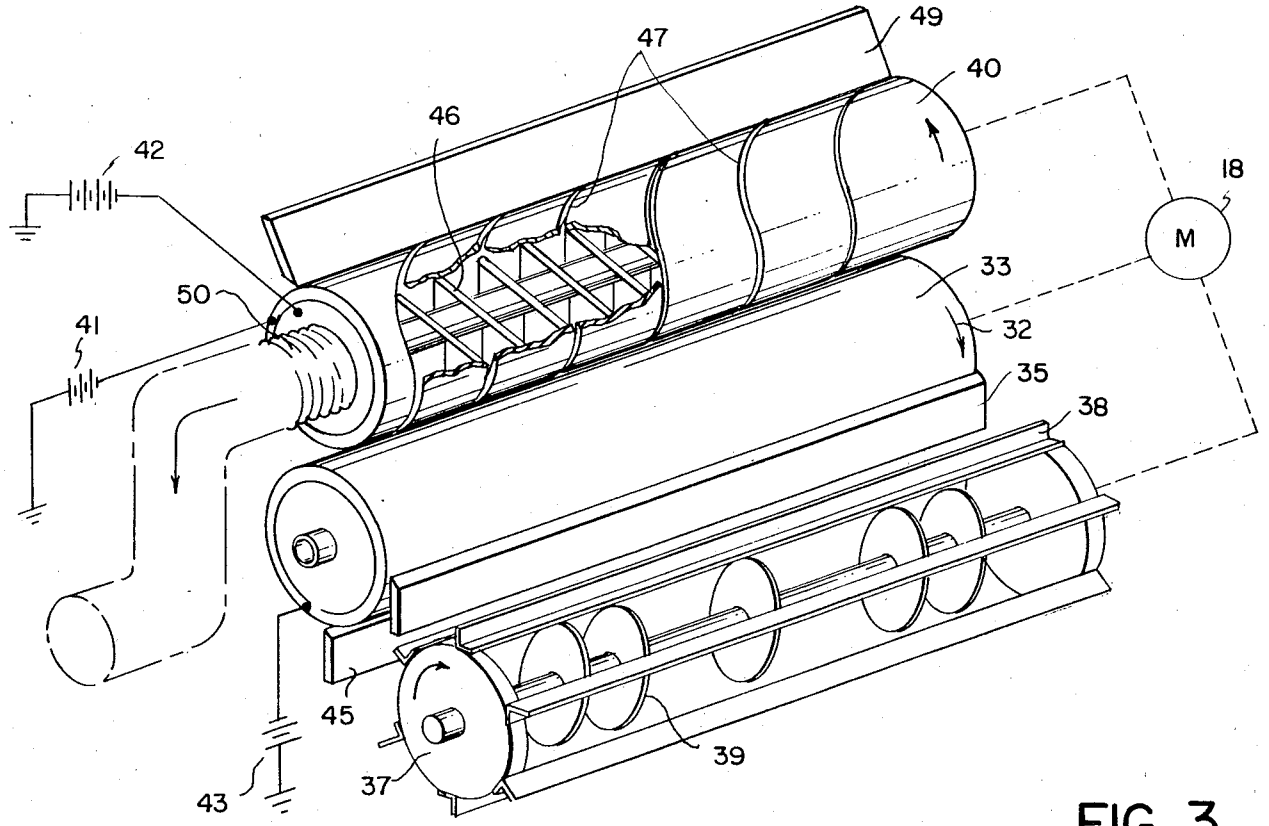
FIG. 3 is a perspective view of a portion of the cleaning apparatus shown in FIG. 2.

With reference now to FIGS. 2 and 3, the cleaning station comprises a detoning magnetic cleaning brush 32. The brush has an outer cylinder or shell 33 driven in a clockwise direction and formed of a non-magnetic material; e.g., chrome, brass, aluminum, copper or stainless steel or a composite comprising a nonconductor, such as fiberglass, plated with one of the aforementioned materials. Conventional means (not shown) are provided coupling the shell to motor 18 for rotating the shell in the clockwise direction. The shell is spaced proximate to the photoconductor so that the nap formed by aligned magnetic carrier beads can fill the small gap or nip region between the photoconductor and the shell. Arranged within the shell is a core 34 comprising twelve permanent bar magnets. The magnets are mounted around the periphery of the core and adapted to rotate counterclockwise as a unit so that the bristles formed by the carrier beads on the periphery of the shell are sufficiently active to remove substantially all of the residual toner particles from the web 16. Of course, other suitable magnet arrangements may also be used and the core may be made stationary. As is known in the art, the movement of the carrier beads, in attempting to maintain alignment with the changing magnetic field, provides a scrubbing action on the web to cause removal of residual toner particles adhering thereto. Specifically, it is believed that upon entering the aforementioned nip region, the residual toner particles on the web are bombarded by the high velocity carrier particles in the magnetic brush nap. This bombardment mechanically exceeds the toner to photoconductor contact forces thus allowing the electrostatic field (between a grounded layer of the web 16 and a negatively biased surface of the magnetic brush roller) to cause the residual toner particles to migrate away from the web into the carrier particle nap of the magnetic brush. In the nap, triboelectric charging causes the toner particles to adhere to the rapidly moving carrier particles, thus providing for transport of the toner particles out of the nip region. To facilitate toner removal from the web, a positive charging corona charger 30 and a rear erase lamp 29 may be located upstream of the cleaning unit to neutralize any charge remaining on the web and thus reduce the adherence forces of the toner to the web. As a result of this treatment, the toner may be biased slightly electrically positive. A negative electrical bias is impressed upon the surface of the shell by a D.C. source 43 to further induce toner particles to leave the photoconductor.

Carrier material is continuously removed from the shell 33 by a skiving blade 35 and will fall into a carrier mixture chamber 36 wherein the carrier beads are continuously mixed by suitable rotating mixing paddles 39 formed in the interior of carrier transport wheel 37. The wheel comprises an open structure permitting magnetic carrier beads or material to enter the inside portion thereof and to be worked back and forth by the mixing paddles located on the inside of the wheel so that mixing occurs as the wheel is rotated. The wheel also includes a series of trays 38 located on its periphery to carry magnetic carrier beads towards the magnetic cleaning brush. The magnetic carrier beads are attracted to the magnetic brush and collect thereon for movement towards the nip formed between the brush and the photoconductor. A compacting skive 45 is provided spaced from the periphery of the shell to smooth out and control the thickness of the layer of carrier beads thereon.

After toner is removed from the photoconductor onto the shell of the magnetic brush roller, the surface of the shell rotates to move the toner to a stripping area. In this area, a small gap is provided between the outer layers of the magnetic carrier bead bristles on the magnetic roller and a surface of a hollow rotating detoning roller 40. Preferably, no more than a monolayer of toner is desired to be created on the detoning roller during movement through the stipping area. In this regard, it is preferred that the surface speed of the detoning roller be at least equal to but no more than twice the average tangential velocity of the carrier particles on the shell. The velocity of the carrier particles will be a vector sum of the velocity of the shell plus the velocity of the carrier particles relative to the shell as they move to align themselves with the changing magnetic field. The surfaces of the detoning roller and the shell may be rotating either current or countercurrent to each other. The detoning roller comprises an outer surface area formed of electrically conducting material that is movable about a closed path. In its preferred form, it comprises a cylindrical surface which rotates about its axis and which extends for the full width of the magnetic roller and that of the photoconductor.

The outer surface of the detoning roller 40 may comprise an electrically conductive metal layer plated, coated or laminated on an electrically insulative hollow cylinder formed of a plastic or polymeric composition. An electrically negative D.C source 41 electrically biases the conductive layer negatively relative to the shell 33 to attract the electroscopic toner particles from the shell and cause same to jump the gap between the two surfaces. The magnetic carrier particles are magnetically attracted to the magnetic brush and tend to remain there rather than being substantially induced to move to the detoning means.

Included within the cylindrical detoning roller 40 is an electrically conductive auger 46 that is negatively electrically biased by a suitable D.C. source 42. Auger 46 is biased more negatively than the surface of detoning roller 40. The higher negative bias attracts the slightly positively charged toner particles into the hollow of detoning roller 40. Cutouts are provided in the surface of the detoning roller to define access apertures 47 to the hollow space confined within the detoning roller. These apertures are of a size large enough to allow toner on the detoning roller to be scraped or mechanically swept from the surface of the detoning roller by a skiving blade 49 and to pass through the aperture into the space. This toner is then transported by the stationary nonrotating auger, due to the rotation of the detoning roller, to a collection site. The apertures may be formed in the shape of a helix, as shown, or in other configurations. A vacuum line 50 including vacuum forming means (not shown) may be provided coupled to a point adjacent one end of the auger 46 to facilitate removal of toner from the cleaning apparatus to a remote collection area.

It will be appreciated that advantages of the invention are in the elimination of the need for a separate drive to be provided to an auger as indicated in the description of the prior art. A further advantage is in the elimination of having toner scraped from a detoning roller and allowed to free fall into a tray type collection device with greater risks of contamination of parts of the cleaning apparatus with loose flying toner particles.

Although the invention has been described with regard to a detoning roller, it will be understood that a detoning belt or other closed surface having suitable apertures may be used for collecting toner therewithin.

The invention has been described in detail with particular reference to a preferred embodiment thereof, but it will be understood that variations and modifications can be effected within the spirit and scope of the invention.

I claim:

1. In a cleaning apparatus for removing residual toner particles from a surface of a photoconductor, the apparatus including magnetic brush means including magnetic particles forming a nap for capturing toner particles from the surface; detoning means including a surface movable about a closed path for removing toner particles from the magnetic brush means and on to the surface of the detoning means and the improvement which comprises:

means defining apertures on the surface of the detoning means, said apertures sized to permit toner particles removed from the photoconductor to pass through said apertures;

toner conveying means for directing the toner particles from the surface of the detoning means through said apertures into a space encompassed by the surface of the detoning means.

2. The apparatus of claim 1 and wherein the aperture means are formed in the shape of a helix.

3. The apparatus of claim 1 and including means for electrically biasing the detoning means to a potential to cause toner particles to move from the magnetic brush means onto the surface of the detoning means without causing a substantial amount of the magnetic particles to also move onto the surface of the detoning means.

4. The apparatus of claim 1 and including skiving means operating on the surface of the detoning means for mechanically sweeping toner from such surface into the apertures.

5. The apparatus of claim 1 and wherein the toner conveying means includes stationary, nonrotating auger means for conveying the toner particles to a collecting station.

6. The apparatus of claim 5 and including skiving means operating on the surface of the detoning means for mechanically sweeping toner from such surface into the apertures.

7. The apparatus of claim 5 and wherein the stationary non-rotating auger means is negatively electrically biased by a D.C. source.

8. The apparatus of claim 5 and wherein vacuum forming means are coupled with the auger means to remove toner particles.

9. The apparatus of claim 5 and wherein the detoning means includes a roller having a width dimension approximately the same as a width dimension of the surface of the photoconductor.

10. The apparatus of claim 9 and wherein the magnetic brush means comprises a roller comprising an outer shell means for carrying the nap of magnetic particles and a core including a plurality of magnet means located within the shell and rotatable relative to the shell means for creating an agitating movement of the magnetic carrier particles on the shell means.

11. The apparatus of claim 10 and including means for electrically biasing the detoning means to a potential to cause toner particles to move from the magnetic brush means onto the surface of the detoning means without causing a substantial amount of the magnetic particles to also move onto the surface of the detoning means.

12. The apparatus of claim 11 and including skiving means operating on the surface of the detoning means for mechanically sweeping toner from such surface into the apertures.

13. In a cleaning apparatus for removing residual toner particles from a surface of a photoconductor, the apparatus including magnetic brush means including magnetic particles forming a nap for capturing toner particles from the surface; detoning means including a surface movable about a closed path for removing toner particles from the magnetic brush means and on to the surface of the detoning means and the improvement which comprises:

means defining apertures on the surface of the detoning means, said apertures sized to permit toner particles removed from the photoconductor to pass through said apertures;

toner conveying means for directing the toner particles from the surface of the detoning means through said apertures into a space encompassed by the surface of the detoning means;

auger means for conveying the toner particles to a collecting station located in the space encompassed by the surface of the detoning means.

* * * * *